United States Patent [19]

Kinoshita et al.

[11] Patent Number: 4,489,685

[45] Date of Patent: Dec. 25, 1984

[54] MULTI-CYLINDER INTERNAL COMBUSTION ENGINE

[75] Inventors: Mitsutaka Kinoshita; Tatsuro Nakagami; Nobuaki Murakami; Norio Endo; Fumio Tamura; Yoshiaki Danno, all of Kyoto, Japan

[73] Assignee: Mitsubishi Jidosha Kogyo Kabushiki Kaisha, Tokyo, Japan

[21] Appl. No.: 605,988

[22] Filed: May 2, 1984

Related U.S. Application Data

[63] Continuation of Ser. No. 359,864, Mar. 19, 1982, abandoned.

[30] Foreign Application Priority Data

Mar. 23, 1981 [JP] Japan ..... 56-40449

[51] Int. Cl.[3] ..... F02D 13/06

[52] U.S. Cl. ..... 123/198 F; 123/90.15; 123/481; 123/580

[58] Field of Search ..... 123/198 F, 481, 580, 123/90.15, 90.16

[56] References Cited

U.S. PATENT DOCUMENTS

| | | | |
|---|---|---|---|
| 4,104,991 | 8/1978 | Abdoo | 123/198 F |
| 4,144,863 | 3/1979 | Abdoo | 123/198 F |
| 4,227,505 | 10/1980 | Larson et al. | 123/198 F |
| 4,263,782 | 4/1981 | Matsumoto et al. | 123/198 F |

*Primary Examiner*—Ira S. Lazarus

[57] ABSTRACT

In a multi-cylinder internal combustion engine having a plurality of cylinders which are supplied with air via one common throttle valve and a control unit for regulating the number of operating cylinders which suspends the operation of an arbitrary number of cylinders by intercepting the air supply to said cylinders, it is noted at a point the output of the engine under $Z_1$-cylinder operation coincides with the output under $Z_2$-cylinder operation at the same degree of opening of the throttle valve at a given constant rate of engine rotation. Based on such a fact, the multi-cylinder internal combustion engine is made capable of shifting to and from $Z_1$-cylinder operation and $Z_2$-cylinder operation in the proximity of said point where these outputs coincide. This way, there will be no fluctuation in the output nor shock at the time of switching, and the control unit for this purpose can be made simple in construction.

6 Claims, 3 Drawing Figures

MULTI-CYLINDER INTERNAL COMBUSTION ENGINE

This application is a continuation of application Ser. No. 359,864, filed Mar. 19, 1982, now abandoned.

BACKGROUND OF THE INVENTION

The present invention relates to a multi-cylinder internal combustion engine which is capable of regulating the number of cylinders in operation by shifting a given number of cylinders to rest, and aims to obviate shocks caused by fluctuation in the output at the time of such switching.

There have been known in prior art multi-cylinder engines which can increase the combustion efficiency of cylinders in operation to prevent toxic exhaust gas or which can reduce pumping loss through an increase in load rate to better fuel economy, by shifting the number of operating cylinders from the total number at low-load to a given number. There are conventionally known various methods for suspending the operation of cylinders such as disclosed in U.S. Pat. No. 4,221,200, U.S. Pat. No. 4,221,201 and BP No. 2,075,118. In one of such methods, the operation of the intake and exhaust valves(s) is suspended; it is also known to stop the operation of a fuel supply system provided for each cylinder (in many cases an electrically controlled fuel injection valve provided on branched pipes of the intake manifold) or the like.

These multi-cylinder engines, however, are defective in that the output of the engine would fluctuate when the operation of cylinders is suspended, and when carried on automotive vehicles, it might cause a shock, presenting difficulties in smooth driving.

SUMMARY OF THE INVENTION

The present invention aims to provide a multi-cylinder internal combustion engine characterized by a control unit which is capable of shifting the number of cylinders in operation from an arbitrary number (hereinafter called) $Z_1$-cylinder operation) to another arbitrary number (hereinafter called $Z_2$-cylinder operation) without causing fluctuation in the output nor shock. In order to achieve the above object, the multi-cylinder engine according to the present invention comprises a plurality of cylinders which are supplied with air via one common throttle valve and a control unit for regulating the number of cylinders which suspends the operation of a given number of cylinders by intercepting the air supply to said cylinders. In order to shift the number of cylinders in operation, the control unit is so constructed as to shift said number at an arbitrary engine rotation rate under a driving condition when the outputs before and after shift substantially coincide at the same degree of opening of the throttle valve.

BRIEF DESCRIPTION OF THE DRAWINGS

FIG. 1 shows a graph explaining a cross point;

FIG. 2 shows the structure of the variable displacement engine;

FIG. 3 is a block diagram of the control unit.

DETAILED DESCRIPTION OF THE INVENTION

The present invention will now be described in detail by way of an embodiment with reference to the accompanying drawings.

In a variable displacement engine with a mechanism having a plurality of cylinders which are supplied with air via one common throttle valve and a system which intercepts the air supply to said cylinders held in suspension via said valve by such as the method for stopping intake/exhaust valve operation, the method for introducing atmospheric air, the method for recycling exhaust gas etc., there exists a point at a certain degree of opening of the valve (hereinafter called the cross point) where the output of the engine under the $Z_1$-cylinder operation, i.e. 4-cylinder operation in FIG. 1, coincides with the output under the $Z_2$-cylinder operation, i.e. 2-cylinder operation in FIG. 1, when the degree of opening of the throttle valve is varied while maintaining the rate of rotation of the engine constant. This is because while in the driving range where the degree of opening of the throttle valve is smaller, the combustion efficiency in the 4-cylinder operation decreases and the pumping loss increases, such defects are alleviated in the 2-cylinder operation.

Based upon such a fact, it will therefore be possible to shift the operation smoothly without causing fluctuation in the output if such shifting to and from the $Z_1$-cylinder operation and the $Z_2$-cylinder operation is conducted at a point where the outputs at the same degree of opening of the throttle valve coincide at respective rate of rotation or at the cross point. Therefore, a memory is provided to store in advance the parameters of outputs which correspond to the cross point, such as the degree of opening of the throttle valve, pressure at the intake manifold, etc. for respective rate of rotation of the engine. The engine is controlled by a command signal for suspending the cylinders transmitted by comparing the values stored in the memory with the actual parameters. Theoretically this shifting can be conducted at the cross point. Shifting to and from just at the cross point, however, "hunting" occurs on the engine which makes driving unstable and smooth switching is made difficult. Hysteresis is therefore provided in practice, and the shifting is conducted at two points, a and b, in FIG. 1 to solve the above problem.

Figure 2:
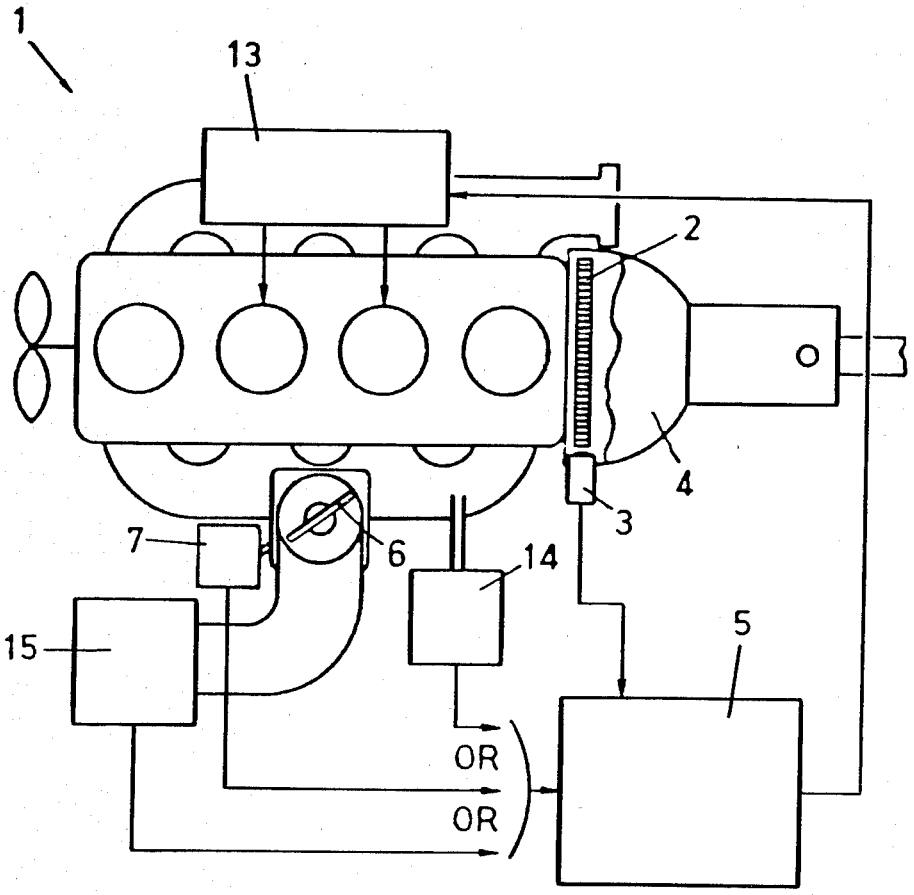

The control unit for switching to and from the $Z_1$- and $Z_2$-cylinder operations will now be described referring to FIG. 2.

The control unit to be provided on a 4-cylinder engine 1 comprises a magnet pickup 3 for detecting the rotation pulse of the engine provided opposing the ring gear of the flywheel within the flywheel housing 4, and the output signal therefrom is transmitted to the control unit 5. As a detector for detecting the output of the engine 1 at the cross point, a throttle sensor 7 is provided to determine the degree of the throttle valve opening as a parameter. A differential transformer or the like with the movable part fixed on the rotational axis of the throttle valve 6 may be used for this purpose. The output signal of the throttle sensor 7 is also transmitted to the control unit 5.

Figure 1:
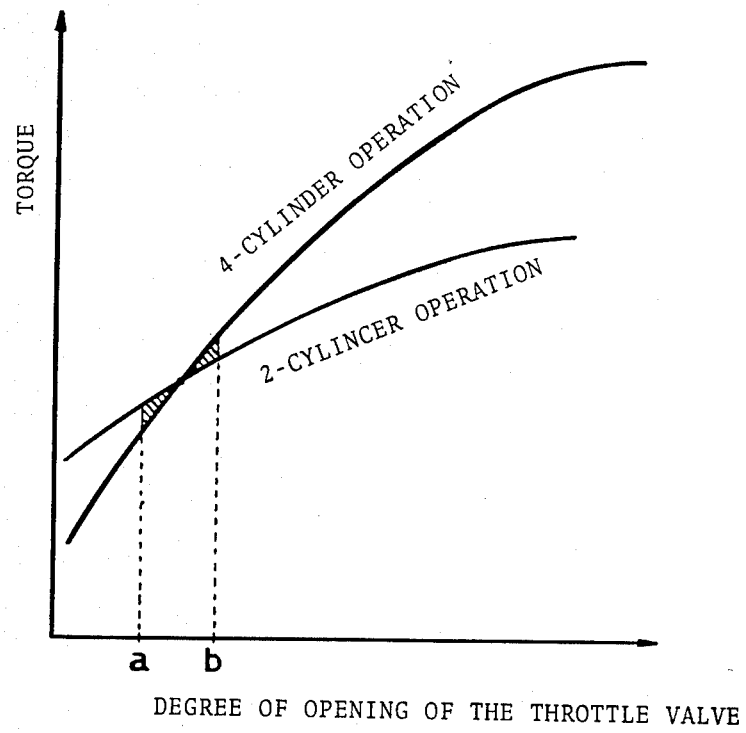
FIGS. 1–3 show embodiments according to the present invention.
Figure 3:
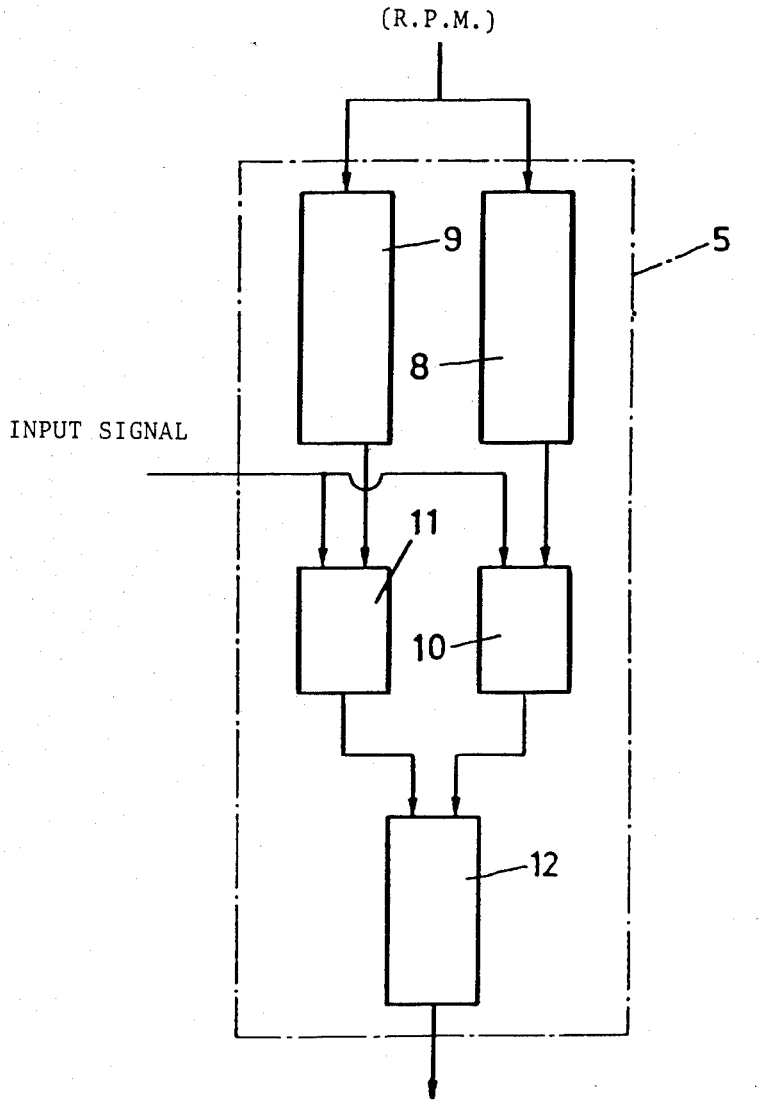

As shown in the block diagram of FIG. 3, the control unit 5 comprises a memory 8 of cylinder suspension load which stores the output at the point a of FIG. 1, where the operation is shifted from 4-cylinders to 2-cylinders, in terms of the degree a' of the throttle valve opening 6, a memory 9 of cylinder suspension releasing load which stores in advance the output at the point b in FIG. 1, where suspension of cylinders is released, in terms of the degree of opening b' of the throttle valve 6; and two comparators 10 and 11 which compare the output signals from these two memories 8, 9 with the output signal from the throttle sensor 7 which indicates the degree of opening of the throttle valve 6. One of said comparators 10 detects the point where 4-cylinder operation is switched to 2-cylinder operation while the other comparator 11 detects the point where 2-cylinder operation is switched back to 4-cylinder operation. The outputs from the comparators 10 and 11 are transmitted to a unit 12 for determining the number of operating cylinders and the comparators also transmit signals to the cylinder suspension unit 13. A conventional device such as a mechanism for stopping intake/exhaust valve operation may be used as said unit 13 for suspending the valve(s). It is noted that such a unit must be able to prevent the air from coming into the suspended cylinders through the throttle valve. The detecting means for the output of the engine at the cross point is not restricted to the throttle sensor 7 which detects the degree of opening of the valve 6 as described above, but a pressure sensor 14 may be used to detect the pressure at the intake manifold. Further, in the case of a 4 cycle engine, the amount of air intake per a cylinder in a cycle is expressed as total air intake (number of cylinder x number of rotation/2), and is proportional to the pressure at the intake manifold. It is therefore possible to detect the amount of air intake by an air flow sensor 15. When the pressure sensor 14 or the air flow sensor 15 is employed, it goes without saying that the output at the cross point which corresponds with the sensors must be stored in the load memories 8 and 9. It is also possible to detect the rate of rotation of the engine from the ignition pulse of the distributor.

Although the embodiment has been explained in terms of switching 4-cylinder operation ($Z_1=4$) to 2-cylinder operation ($Z_2=2$), it is not limited to a 4 cylinder engine but the number of $Z_1$ and $Z_2$ may be selected arbitrarily. For example, a 4-cylinder engine can be operated using 4, 3 or 2 cylinders.

As has been described in the foregoing with regard to the embodiment, the present invention enables a smooth operation of an engine without any shock due to fluctuation in the output at the time of switching, since switching of $Z_1$-cylinder operation to $Z_2$-cylinder operation is conducted in the proximity of the cross point where the output of the respective operations coincide.

What we claim:

1. A multi-cylinder internal combustion engine comprising a plurality of cylinders which are supplied with air via one common throttle valve, an operating cylinder regulation unit which suspends the operation of an arbitrary number of cylinders by intercepting the air supply to said cylinders, a parameter detection means which detects the parameter indicating the output torque of said engine, and a control means which receives as input the result of detection of said parameter detection means and outputs a command signal to said operating cylinder regulation unit so as to shift the number of operating cylinders when said parameter coincides with a set value, which is characterized in that said set value is determined at the value of the parameter of the time when the engine output torque before and after such shift becomes substantially identical at the same degree of throttle valve opening for the switching by said regulation unit.

2. The multi-cylinder internal combustion engine as claimed in claim 1 which is characterized in that said control means comprises a first means which stores or calculates said set value, and a second means which compares said set value output from said first means with the result of detection by said parameter detection means and transmits said command signal in accordance with the result.

3. The multi-cylinder internal combustion engine as claimed in claim 2 which is characterized in that a revolution rate detection means is provided to detect the engine revolution rate, the result of detection therefrom being fed to said first means, and that said first means is constructed to store or calculate said set value as a function of said engine revolution rate and to output said set value which has been determined in accordance with the engine revolution rate detected by said detection means to said second means.

4. The multi-cylinder internal combustion engine as claimed in anyone of claims 1 through 3 which is characterized in that said parameter concerns the degree of throttle valve opening and said parameter detection means comprises a detection means for detecting the degree of throttle valve opening.

5. The multi-cylinder internal combustion engine as claimed in anyone of claims 1 through 3 which is characterized in that said parameter concerns the intake manifold pressure and said parameter detection means comprises a detection means which detects said intake manifold pressure.

6. The multi-cylinder internal combustion engine as claimed in anyone of claims 1 through 3 which is characterized in that said parameter concerns intake air amount and said parameter detection means comprises a detection means which detects the amount of intake air.

* * * * *